US005884517A

United States Patent [19]

Yogo

[11] Patent Number: 5,884,517

[45] Date of Patent: Mar. 23, 1999

[54] BENDING DEVICE

[75] Inventor: Teruaki Yogo, Nagoya, Japan

[73] Assignee: Kabushiki Kaisha Opton, Aichi-ken, Japan

[21] Appl. No.: 994,277

[22] Filed: Dec. 19, 1997

[51] Int. Cl.[6] ..... B21D 7/08

[52] U.S. Cl. ..... 72/166; 72/173; 72/307

[58] Field of Search ..... 72/173, 172, 166, 72/170, 388, 319, 307

[56] References Cited

U.S. PATENT DOCUMENTS

| | | | |
|---|---|---|---|
| 4,367,641 | 1/1983 | Mizutani | 72/166 |
| 4,391,116 | 7/1983 | Yogo | 72/166 |
| 5,031,291 | 7/1991 | Shimokata | 29/33 T |
| 5,239,850 | 8/1993 | Shimokata | 72/168 |
| 5,259,231 | 11/1993 | Kutschker | 72/319 |
| 5,425,257 | 6/1995 | Kitsukawa | 72/166 |

FOREIGN PATENT DOCUMENTS

| | | |
|---|---|---|
| 0 032 795 A2 | 7/1981 | European Pat. Off. . |
| 1154824 | 6/1989 | Japan . |

OTHER PUBLICATIONS

Japanese Patent Abstract, JP 08 257643 A, vol. 097, No. 002, dated 28 Feb. 1997.

*Primary Examiner*—Daniel C. Crane

*Attorney, Agent, or Firm*—Davis and Bujold

[57] ABSTRACT

A bending device which can reduce a change in bend radius caused by movement of a bending jig and which can twist an elongate material using a simple construction. The bending device has a positioning jig 6 with a clearance opening formed therein for passing a material 1, positioning jig 6, for receiving the material, a bending jig 12 with a clearance opening for passing the material 1. The bending jig is supported on a sliding mechanism 26 movable in a plane perpendicular to a material supply direction controlled by a sliding drive mechanism 32. The device is also provided with a first bending mechanism 51 for pivoting the bending jig 12 around a first axis orthogonal to the length of the elongate material and a second bending mechanism 55 for pivoting the bending jig 12 around a second bending axis 52 orthogonal to the length of the material and the first bending axis to bend the material 1. On the sliding mechanism 26, a twisting mechanism 41 is provided at a predetermined distance from the material 1 for pivoting the bending jig 12 around a pivot axis 24 parallel with the length of the material.

6 Claims, 7 Drawing Sheets

BENDING DEVICE

BACKGROUND OF THE INVENTION

The present invention relates to a bending device for bending a pipe, a molding of an automobile window frame, a window frame sash and other elongate materials having various cross-sectional configurations.

A heretofore known bending device is, as disclosed in a publication of Japanese Patent Application No. Hei 1-154824, provided with a positioning jig with a clearance formed therein for passing an elongate material a bending jig having a clearance formed therein for passing the material supplied from the positioning jig, and for bending the material by moving the bending jig in a plane perpendicular to a material supply direction.

In this conventional bending device, as shown in FIGS. 6A and 6B, a material 100 being supplied is bent to a predetermined bend radius by moving a bending jig 102. At the start of a bending process, when a bent portion of the material 100 is supplied to the bending jig 102, the bending jig 102 is moved to a position in accordance with the bend radius. Subsequently, the bending jig 102 is moved back to a position coaxial with a positioning jig 104, thereby ending the bending process. As shown in FIG. 6A, at the start of the bending process, while the bending jig 102 is moving, a bend radius of the material 100 is changed from a radius R1 to a smaller radius R2. Subsequently, as shown in FIG. 6C, when the bending jig 102 reaches a position corresponding to a bend radius R3, the bending jig 102 stops moving to bend the material 100 to the predetermined bend radius.

Subsequently, when the bending jig 102 is moved back to its original position, the bend radius will change to a larger bend radius. As a result, especially when the material is bent to a small bend radius, the bend radius changes substantially between the start and the end of the bending process.

In another conventional bending device there is provided a rotary plate on which a bending jig is rotatably supported. While supplying the material, the material is bent by moving the bending jig in a plane perpendicular to a material supply direction, and twisted by rotating the rotary plate about the material. In this conventional bending device, to rotatably support the rotary plate centered on the material, a rotation axis of the rotary plate needs to be rotatably supported by plural rollers and mechanism is unduly complicated.

SUMMARY OF THE INVENTION

An object of the invention is to provide a bending device which can reduce variations in a bend radius caused when a bending jig moves.

Another object of the invention is to provide a bending device which can twist a material with a simple mechanism.

According to the invention there is provided a bending device which comprises: a positioning jig with a clearance opening formed therein for passing a supplied elongate material; a bending jig with a clearance opening formed therein for passing said material; a sliding mechanism for supporting said bending jig at a position to which said material is supplied from said positioning jig, said sliding mechanism being movable in a plane perpendicular to a material supply direction; a sliding drive mechanism for driving said sliding mechanism in said plane to move said bending jig; a first bending mechanism for pivoting said bending jig around a first bending axis orthogonal to the length of the elongate material; and a second bending mechanism for pivoting said bending jig around a second bending axis which is normal to said first bending axis and orthogonal to the length of the elongate material.

Preferably wherein said first bending axis extends horizontally from said bending jig, and said second bending axis extends vertically from a support frame which supports said first bending mechanism and also preferably said first bending axis is defined by trunnions on opposite sides of said bending jig and rotatably supported on said support frame.

The first bending mechanism may comprise two hydraulic motors for pivoting said bending jig about said first bending axis.

According to another aspect of the invention a bending device which comprises: a positioned jig with a clearance opening formed therein for passing an elongate material; a bending jig with a clearance opening formed therein for passing said material; a sliding mechanism for supporting said bending jig at a position to which material is supplied from said positioning jig, said sliding mechanism being movable in a plane perpendicular to a material supply direction; a sliding drive mechanism for driving said sliding mechanism to move said bending jig; and a twisting mechanism provided on said sliding mechanism and spaced from said material for swinging said bending jig around a swinging axis parallel with the length of said elongate material.

Preferably the invention further comprises a first bending mechanism for pivoting said bending jig around a first bending axis orthogonal to the length of the elongate material, and a second bending mechanism for pivoting said bending jig around a second bending axis which is normal to said first bending axis and orthogonal to the length of the elongate material.

BRIEF DESCRIPTION OF THE DRAWINGS

The invention will now described, by way of example, with reference to the accompanying drawing, in which.

DETAILED DESCRIPTION OF THE PREFERRED EMBODIMENTS

Embodiments of the invention are now described with reference to the accompanying drawings.

Figure 1:
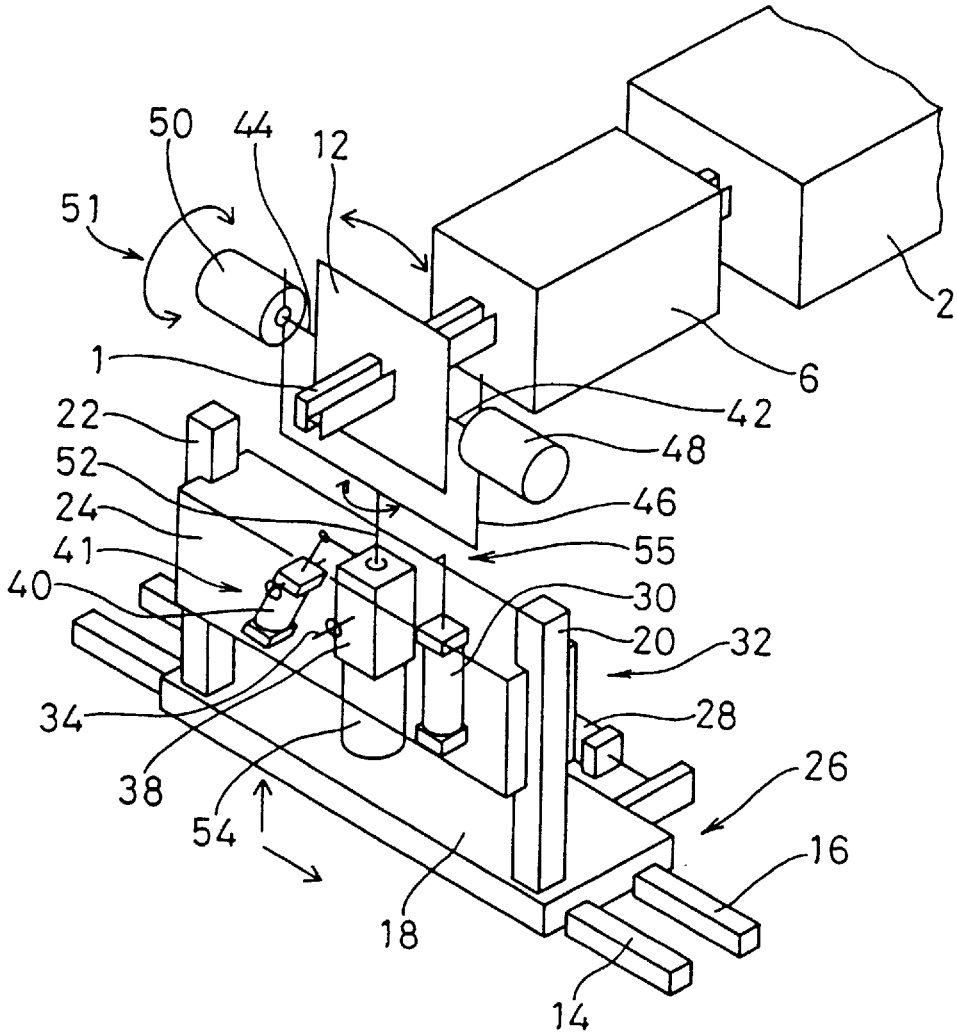
FIG. 1 is a diagrammatic representation of a bending device according to an embodiment of the present invention.

As shown in FIG. 1, in a first embodiment a material 1 is for molding an automobile window frame, although it can be, for example, a pipe. The material 1 may have an asymmetrical cross-sectional configuration which is, preferably, orthogonal with a longitudinal direction of the material.

Figure 3:
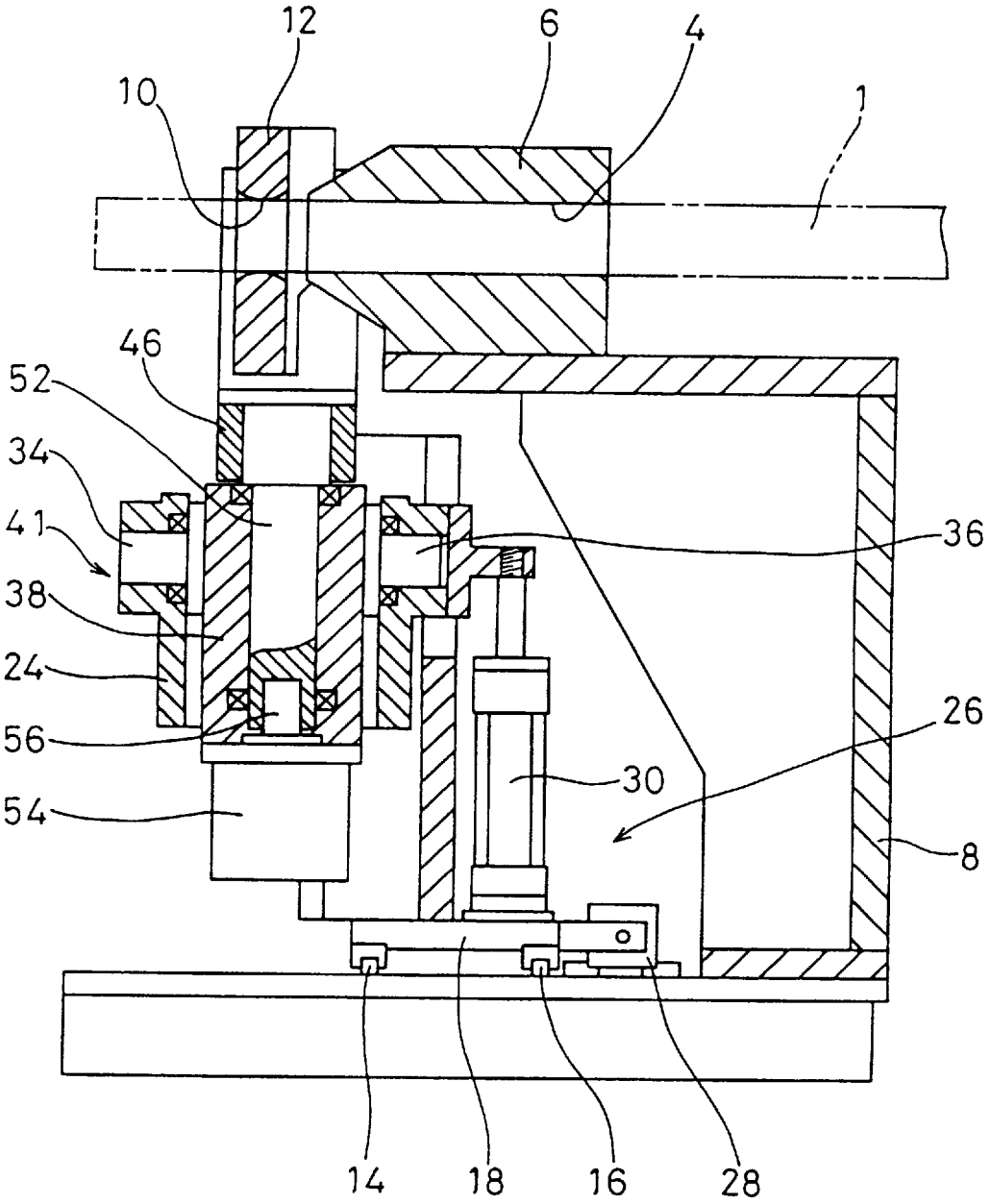
FIG. 3 is a sectional view showing a main part of the bending device according to the embodiment.

As shown in FIGS. 1 and 3, a bending device of the first embodiment is provided with a supply mechanism 2 for supplying the material 1 in an axial direction. A positioning jig 6 with a clearance opening 4 formed therein for passing the supplied material 1 is provided on a body 8. At a position at which the material 1 has passed the clearance opening 4 in the positioning jig 6 there is, a bending jig 12 with a clearance opening 10 formed therein for passing the material 1.

On the body 8, a pair of rails 14 and 16 are disposed in a direction orthogonal to the material 1. On the rails 14 and 16, a unit 18 is movably along the rails 14 and 16. On the unit 18, a pair of rails 20 and 22 are provided to guide a vertically movable unit 24.

The rails 14 and 16, the unit 18, the rails 20 and 22 and the vertical moving unit 24 constitute a sliding mechanism 26. When the units 18 and 24 are moved, the vertical moving unit 24 is moved in a plane perpendicular to a supply direction of the material 1.

The unit 18 is driven and moved along the rails 14 and 16 by a cylinder 28 on the body 8, and the vertical moving unit 24 is driven and moved along the rails 20 and 22 by a cylinder 30 built on the longitudinal moving unit 18. The cylinders 28 and 30 constitute a sliding drive mechanism 32 including the sliding mechanism 26.

On the vertical moving unit 24, a pivotable member 38 is pivotably supported via pivot trunnions 34 and 36 which are fixed parallel with the material 1 on both sides of the pivotable member 38. The trunnions 34 and 36 are positioned at a predetermined distance r from a center of the material 1. The pivotable member 38 is driven about the trunnions 34 and 36 by a trunnion cylinder 40 which is pivotably supported by the vertical moving unit 24. The trunnions 34 and 36, the pivotable member 38 and the trunnion cylinder 40 constitute a twisting mechanism 41.

Figure 2:
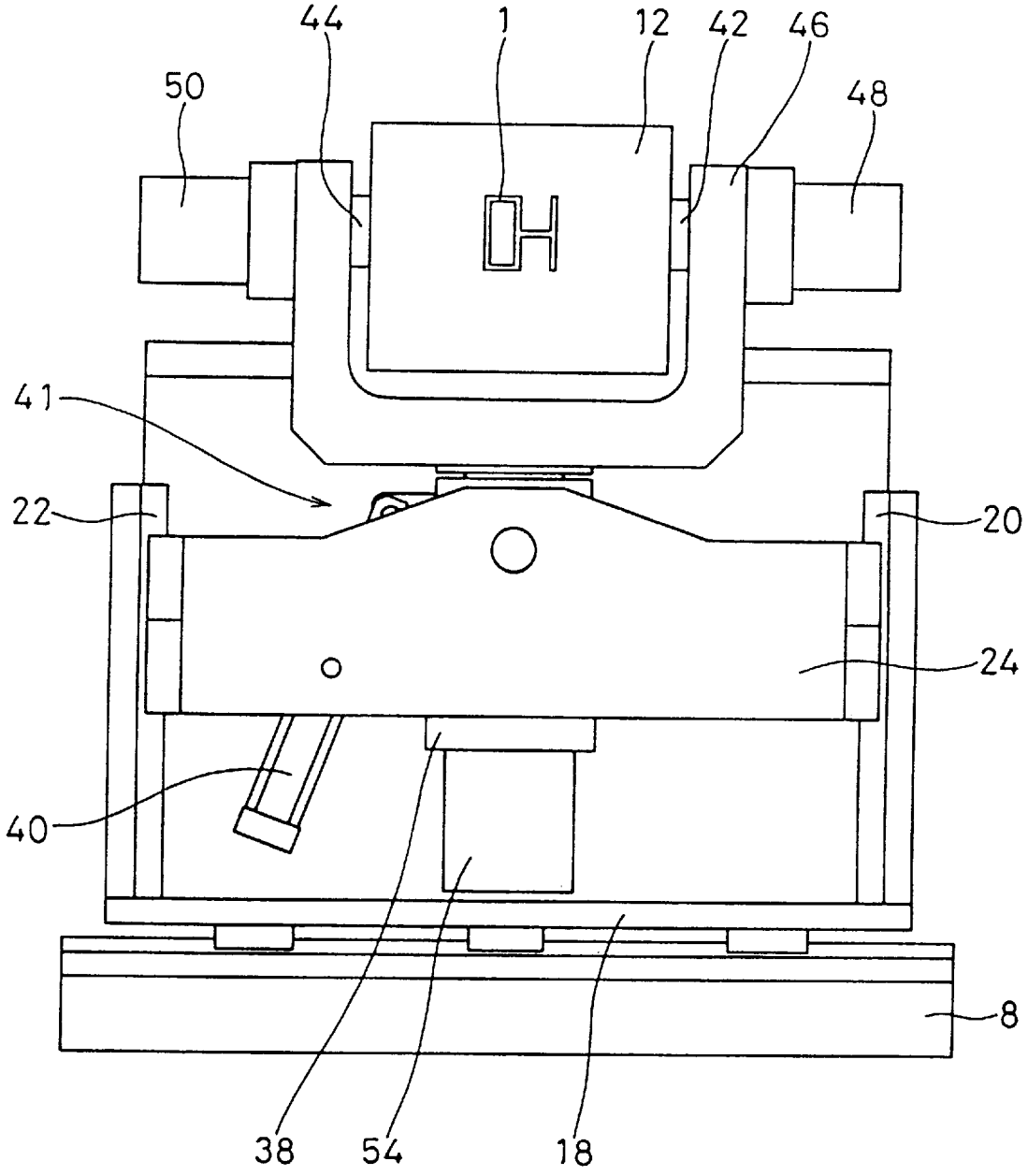
FIG. 2 is a front view of the bending device according to the embodiment.

As shown in FIGS. 1 and 2, the bending jig 12 has bending trunnions 42 and 44 fixed on opposite sides thereof in a direction orthogonal to a longitudinal extension of the material 1. The trunnions 42 and 44 are pivotably supported on a U-shaped support frame 46.

Figure 5A:
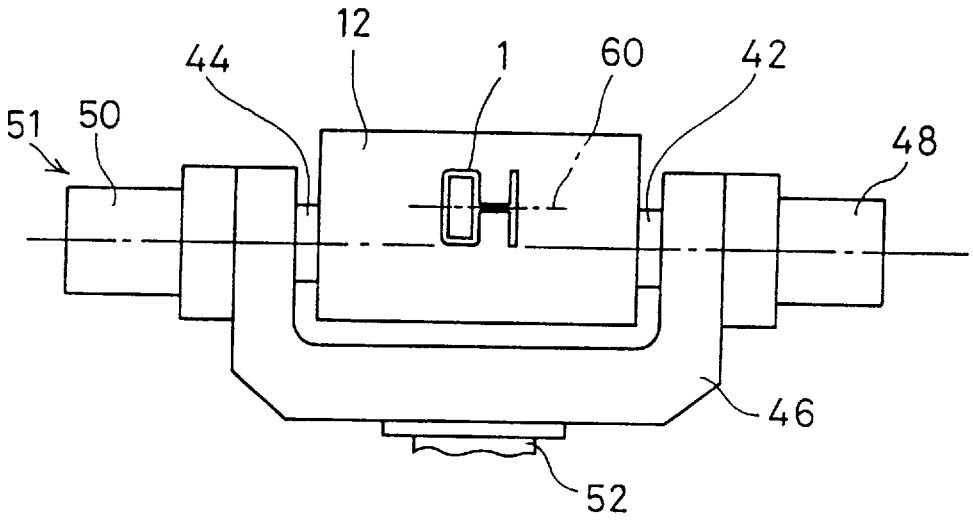
FIGS. 5A and 5B are front views of first and second bending mechanisms according to another embodiment.

On the support frame 46, hydraulic motors 48 and 50 are attached and are connected to the trunnions 42 and 44, respectively. The trunnions 42 and 44 can be pivoted with a large torque by the hydraulic motors 48 and 50. The trunnions 42 and 44 and the hydraulic motors 48 and 50 constitute a first bending mechanism 51. In the first bending mechanism 51, the clearance 10 (see FIG. 3) of the bending jig 12 is formed in such a manner that axes of the trunnions 42 and 44 pass through the center of the material 1. Alternatively, as shown in FIG. 5A, the clearance 10 of the bending jig 12 can be formed in such a manner that the axes of the trunnions 42 and 44 pass a position spaced from a center 60 of the material 1.

Figure 5B:
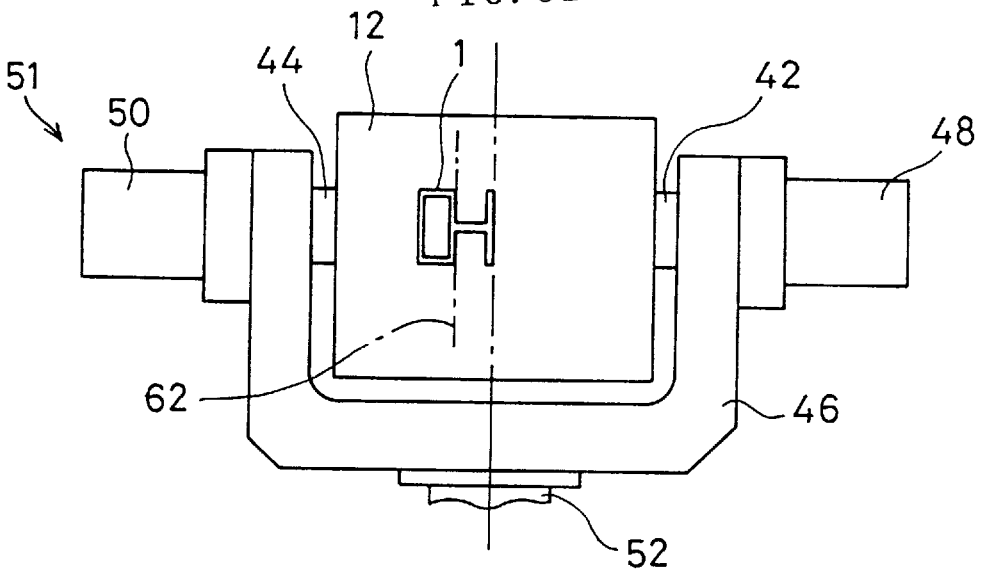
Figure 6A:
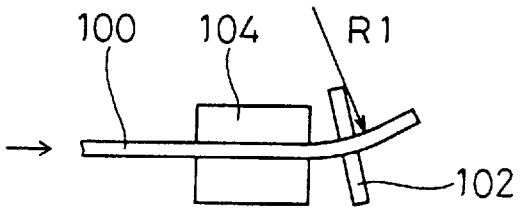
FIG. 6A PRIOR ART
FIGS. 6A, 6B and 6C are explanatory views of a bending operation of a prior-art bending device.
Figure 6B:
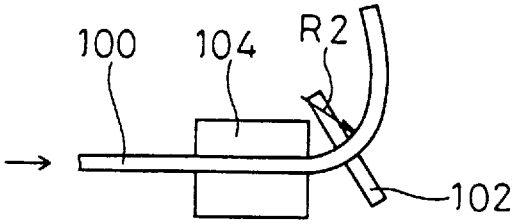
FIG. 6B PRIOR ART
Figure 6C:
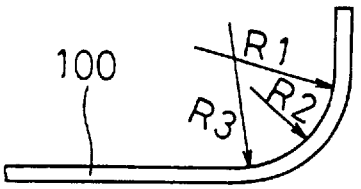
FIG. 6C PRIOR ART

As shown in FIG. 3, the support frame 46 is provided with a downward extending second bending shaft 52 in a direction orthogonal to the longitudinally extension of the material 1 and the axes of the trunnions 42 and 44. The second bending shaft 52 is pivotably supported in the pivotable member 38. A hydraulic motor 54 mounted on the pivotable member 38 to pivot the shaft 52. The support frame 46, the shaft 52 and the hydraulic motor 54 constitute a second bending mechanism 55 shown in FIG. 1. The second bending mechanism 55 is positioned so that the axes of the shaft 52 passes through the center of the material 1. Alternatively, as shown in FIG. 5B, the axes of the shaft 52 is spaced from a center 62 of the material 1.

An operation of the bending device in the embodiment is now described.

First, as shown in FIG. 1, when the material 1 is supplied in an axial direction by the supply mechanism 2, the material 1 passes through the clearance 4 (see FIG. 3) in the positioning jig 6 and further through the clearance 10 in the bending jig 12. When the clearance 4 of the positioning jig 6 and the clearance 10 of the bending jig 12 are coaxial in the supply direction of the material 1, the material 1 passes through the clearances 4 and 10 without being bent.

Figure 4A:
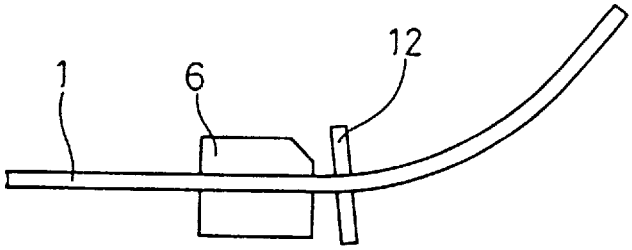
FIGS. 4A and 4B are explanatory view of a bending operation of the bending device according to the embodiment.

Subsequently, as shown in FIG. 4A, to bend the material 1 with a large bend radius, while supplying the material 1, the cylinder 30 is driven to elevate the vertical moving unit 24. Thereby, the clearance 10 of the bending jig 12 moves upward, and the material 1 is bent with a radius corresponding to a movement extent of the bending jig 12. In this case, the hydraulic motors 48 and 50 are driven to pivot the bending jig 12 around the axes of trunnions 42 and 44 in such a manner that the clearance 10 extends along a tangent line of the material 1. Also, when the cylinder 28 is driven to move the unit 18 along rails 14, 16, the material 1 is similarly bent in the longitudinal direction in the same manner.

When the bend radius is large, the movement extent of the bending jig 12 is small. And the bending jig 12 moves to a position corresponding to the bend radius in a short time. Further, the quantity of the material 1 supplied while the bending jig 12 is moving is small. Therefore, while the bending jig 12 is moving, the portion of the material 1 bent with a larger bend radius is minimized.

Also, at the end of the bending operation, the bending jig 12 can return to its original position in a short time. Therefore, while the bending jig 12 is returning, a portion of the material 1 bent with a larger bend radius is minimized. Further, when the cylinder 28 is driven to move the unit 18 along rails 14, 16, the material 1 is similarly bent in the longitudinal direction.

Figure 4B:
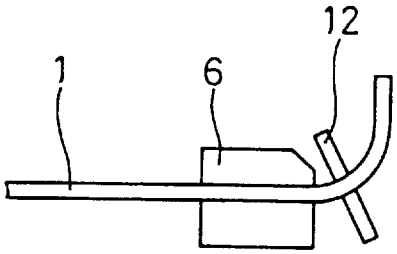

On the other hand, as shown in FIG. 4B, to bend the material 1 with a small bend radius, the hydraulic motors 48 and 50 are driven, thereby pivoting the bending jig 12 on the trunnions 42 and 44 at an angle corresponding to the bend radius. In this case, the cylinder 30 may be driven to slightly elevate the vertical moving unit 24.

The bending jig 12 can be swung only at a predetermined angle, and further can be pivoted more quickly than the vertical moving unit 24 is vertically moved by the cylinder 30. Therefore, the supply quantity of the material 1 supplied while the bending jig 12 is pivoted is minimized. A portion of the material 1 bent with a larger bend radius is also minimized. Also, at the end of the bending operation, the bending jig 12 can be returned to its original angle quickly. Therefore, a portion of the material 1 bent with a larger bend radius while the bending jig 12 is returning is also minimized.

Also, by pivoting the bending jig 12 with the hydraulic motors 48 and 50, a so-called compression bending of the material and the material 1 can be bent with a small radius by swinging the bending jig 12 with the hydraulic motors 48 and 50.

Further, by pivoting the bending jig 12 around the shaft 52 by the use of the hydraulic motor 54, the material 1 can be bent in the same manner as aforementioned. Since the shaft 52 is provided in a lower portion, a portion above the bending jig 12 is open and a tip of the bent material 1 is prevented from interfering with the bending jig 12.

Additionally, by driving the cylinder 40, the pivotable member 38 can be pivoted about the trunnions 34 and 36 and by vertically and longitudinally moving the bending jig 12 using the cylinders 28 and 30, the material 1 can be twisted.

When the material 1 is a sash having an asymmetrical cross-sectional configuration, the sash is in some cases twisted when bent. In this case, the sash needs to be corrected by twisting the sash in a reverse direction. For this, the cylinder 40 is driven and the pivotable member 38 is pivoted about the trunnions 34 and 36.

Figure 7:
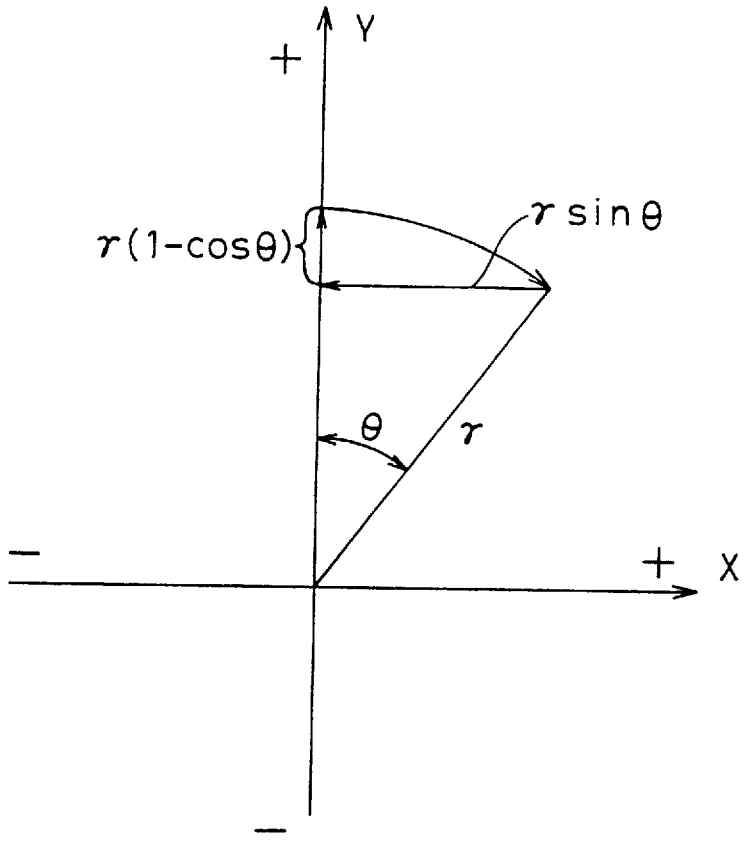
FIG. 7 is an explanatory view of a movement quantity of a sliding mechanism for twisting a material in the bending device according to the invention.

FIG. 7 shows a movement extent of the sliding mechanism for twisting the material with the bending device of the embodiment. As shown in FIG. 7, when the pivotable member 38 is pivoted at an angle θ, the clearance 10 of the bending jig 12 rotates drawing a circular arc with a radius r around the trunnions 34 and 36. In this case, a movement extent of the clearance 10 along an X-axis in a plus direction is rsin θ, and a movement quantity thereof along a Y-axis in a minus direction is r(1−cos θ).

Here, to prevent the position of the clearance 10 in the bending jig 12 from deviating, the cylinder 28 is driven and the unit 18 is moved as much as the movement rsin θ along the X-axis in the minus direction. By driving the cylinder 30, the vertical moving unit 24 is moved by r(1−cos θ) along the Y-axis in the plus direction.

In this manner, the bending jig 12 can be tilted at the angle θ without changing its position. The material 1 passed through the clearance 10 can be twisted. Thereby, a twist of the material 1 caused by bending can be straightened. The embodiment is not restricted to the straightening of the twist. The material 1 can be intentionally twisted when bent.

As aforementioned, the material 1 can be twisted with a simple constitution for swinging the bending jig 12 around the trunnions axes 34 and 36. Also, by using the first and second bending mechanisms 51 and 55, the material can be bent with a smaller radius.

What is claimed is:

1. A bending device which comprises:

a positioning jig with a clearance opening formed therein for passing a supplied elongate material;

a bending jig with a clearance opening formed therein for passing said material;

a sliding mechanism for rotatable supporting said bending jig at a position to which said material is supplied from said positioning jig, said sliding mechanism being movable in a plane perpendicular to a material supply direction and said bending jig being rotatable about an axis parallel to the material supply direction with said axis spaced from said material supply direction;

a sliding drive mechanism for driving said sliding mechanism in said plane to move said bending jib;

a first bending mechanism for pivoting said bending jig around a first bending axis orthogonal to the length of the elongate material; and a second bending mechanism for pivoting said bending jig around a second bending axis which is normal to said first bending axis and orthogonal to the length of the elongate material.

2. A bending device according to claim 1, wherein said first bending axis extends horizontally from said bending jig, and said second bending axis extends vertically from a support frame which supports said first bending mechanism.

3. A bending device according to claim 2, wherein said first bending axis is defined by trunnions on opposite sides of said bending jig and rotatably supported on said support frame.

4. A bending device according to claim 3, wherein said first bending mechanism comprises two hydraulic motors for pivoting said bending jig about said first bending axis.

5. A bending device which comprises:

a positioned jig with a clearance opening formed therein for passing an elongate material;

a bending jig with a clearance opening formed therein for passing said material;

a sliding mechanism for supporting said bending jig at a position to which said material is supplied from said positioning jig, said sliding mechanism being movable in a plane perpendicular to a material supply direction;

a sliding drive mechanism for driving said sliding mechanism to move said bending jig; and a twisting mechanism provided on said sliding mechanism for swinging said bending jig around a swinging axis parallel with the length of said elongate material with said axis spaced from said material.

6. A bending device according to claim 5 which further comprises a first bending mechanism for pivoting said bending jig around a first bending axis orthogonal to the length of the elongate material, and a second bending mechanism for pivoting said bending jig around a second bending axis which is normal to said first bending axis and orthogonal to the length of the elongate material.

* * * * *